US006594922B1

(12) United States Patent
Mansfield et al.

(10) Patent No.: US 6,594,922 B1
(45) Date of Patent: Jul. 22, 2003

(54) MEDIAL/LATERAL COUNTER FOOT STABILIZER

(76) Inventors: Paul A. Mansfield, 6854 Eden Rock Ct., Lewisville, NC (US) 27023; Ricky T. Wyatt, 1109 Grinnell Ct., Lewisville, NC (US) 27023; John T. Wyatt, 101 Worthdale Dr., Winston-Salem, NC (US) 27103; Anthony S. Wyatt, 485 Brookridge Dr., Winston-Salem, NC (US) 27103

( * ) Notice: Subject to any disclaimer, the term of this patent is extended or adjusted under 35 U.S.C. 154(b) by 0 days.

(21) Appl. No.: 09/746,178

(22) Filed: Dec. 22, 2000

Related U.S. Application Data

(63) Continuation-in-part of application No. 09/298,867, filed on Apr. 26, 1999, now abandoned.

(51) Int. Cl.[7] ..... A43B 7/14; A43B 7/22; A61F 5/14

(52) U.S. Cl. ..... 36/145; 36/91; 36/92; 36/173; 36/166; 36/169; 36/174; 36/180

(58) Field of Search ..... 36/43, 145, 173, 36/91, 92, 166, 169, 174, 176, 180

(56) References Cited

U.S. PATENT DOCUMENTS 2,008,207 A * 7/1935 Greenberg
2,348,300 A * 5/1944 Klaus
2,403,442 A * 7/1946 Klaus
2,426,735 A * 9/1947 Hiss
2,828,555 A * 4/1958 Ledos
4,084,333 A * 4/1978 Del Vecchio ..... 36/43
4,759,357 A * 7/1988 Allart et al.
5,063,692 A * 11/1991 Suginaka ..... 36/43
5,746,011 A * 5/1998 Hedstrom ..... 36/44
6,173,511 B1 * 1/2001 Perrault ..... 36/174

OTHER PUBLICATIONS

Product brochure and photo for "Foot Control and Support System" (Exhibit A).
AOPA Code, Descprition, Graphic and Interpretation for USB Orthotic (Exhibit B).
Photo of Phase 4 Orthotics, available at www.phase4orthotics.com (Exhibit C).
Photo of Alzner Step Forward Soft Step Orthotic, available at www.serv.net/~skimber/softstep.htm (Exhibit D).

* cited by examiner

*Primary Examiner*—M. D. Patterson
(74) *Attorney, Agent, or Firm*—Cynthia B. Rothschild; Charles W. Calkins; Kilpatrick Stockton LLP

(57) ABSTRACT

The invention relates to an apparatus and methods for incorporating a medial/lateral counter foot stabilizer into shoes. In an embodiment, the medial/lateral counter foot stabilizer of the invention comprises a plantar aspect which extends the length of the sole of a foot, side walls, a metatarsal arch support, a lateral arch support, a medial arch support, and a heel cup counter. The stabilizer of the invention mimics a preferred foot shape, provides support for the metatarsal, medial, and lateral arches, and restricts pronation and supination of the foot. The stabilizer of the invention is designed to be integrated into commercial shoes during the manufacturing process as a method of providing foot support which is currently unavailable in commercial shoes.

29 Claims, 6 Drawing Sheets

MEDIAL/LATERAL COUNTER FOOT STABILIZER

CROSS REFERENCE TO RELATED APPLICATION

This application is a continuation-in-part of, and incorporates in full by reference, Applicants' co-pending non-provisional application having U.S. Ser. No. 09/298,867, filed Apr. 26, 1999.

FIELD OF THE INVENTION

The invention relates to the field of shoes. In particular, the invention describes a method and an apparatus for incorporating a medial/lateral counter foot stabilizer in shoes.

BACKGROUND

During their lifetimes, approximately 60% of all people will have a foot problem of sufficient importance to cause discomfort and/or pain. Most minor foot problems are discussed with amateurs, such as shoe salespersons. More serious problems are referred to primary care physicians or orthopedists. Ideally, pedorthic management begins with an evaluation of footwear and foot support. Regardless of whether a foot problem is minor or substantial, the foot and shoe must work together as a unit, with the shoe providing proper alignment and support of the foot.

There are numerous syndromes that can be caused by misalignment of the calcaneus (heel bone). For example, neuromas are an enlargement of an intermetatarsal nerve sheath. Neuromas usually occur in the space between the third and fourth toes and metatarsals (the third metatarsal space), and are often caused, at least in part, by excessive foot pronation. Shin splints may be caused by tears in the anterior or medial tibial muscles. Anterior shin splints (along the front of the shin) are often associated with repetitive traction of the muscles or repetitive loading with excessive stress, and are usually the result of an imbalance between anterior and posterior tibial muscles. Medial shin splints (along the inside shin) are usually caused by excessive exercise. Both anterior and medial shin splints are exacerbated by excessive pronation. Excessive pronation can also cause calluses and heel spurs.

There are also numerous problems caused by insufficient arch support. For example, lack of support in the medial arch (the main arch along the inside of the foot) can lead to foot fatigue, plantar fasciitis (heel spurs), neuroma pain, or bunions. Lack of support in the metatarsal arch (under the ball of the foot) can cause metatarsalgia (a pain in the ball of the foot), pain in the toes, or decreased balance control. Supporting the lateral arch (on the outer side of the foot) aids in balance and posture, and provides side-to-side stability.

Orthotic inserts have been described for cushioning of the calcaneus or providing arch support. For example, U.S. Pat. No. 4,235,028 describes a heel pad for an athletic shoe having an aperture which cushions the heel, and U.S. Pat. No. 4,137,654 describes an insert which provides a heel cup with a horizontally extending wedge having a decline of 4 to 5 degrees to reduce pronation and supination of the heel. Also, U.S. Pat. No. 4,882,856 describes an insert (and shoes) with a wedge-shaped cushion which has greater resiliency than the remainder of the insert, and is positioned to reduce heel pronation/supination. These inserts generally provide for an elevated heel cushion, and do not provide support for the lateral, medial or metatarsal arches.

U.S. Pat. Nos. 4,718,179 and 5,394,626 describe orthotic inserts which are custom-molded to a patient's foot. The inserts described in these patents utilize a cloth-like padded sole attached to a more rigid elevated heel cap, require elevated lateral and medial stabilizers as a means to elevate the heel, and do not provide significant lateral side-wall support for the heel cap. Similarly, U.S. Pat. No. 4,439,934 (Re 32,698) also describes a two-piece insert utilizing a cloth-like upper attached to a more rigid elevated heel and mid-sole, but requires the mid-sole/heel portion to be generated using layers of fiberglass resin. U.S. Pat. Nos. 4,597,196 and 6,070,342 also describe multipart insole assemblies for a shoe. U.S. Pat. No. 4,597,196 describes an orthotic custom-fitted to a patient's foot and having a flexible (cloth-like) padded upper blank, a relatively rigid cap extending from the heel to the metatarsal region, a moldable, cushion insert between the upper and the blank surrounding the perimeter of the heel, and a pad to cushion the heel and midsole. U.S. Pat. No. 6,070,342 describes an insert having a cloth-like upper attached to a more rigid, U-shaped elevated heel and mid-sole, which has first and second flanges along the lateral and medial side portions to support an elevated heel. Thus, the inserts described in these patents each require a multipart construction using a relatively raised heel cap with a padded upper sole, and do not provide extensive medial and lateral constriction of the heel to control pronation and supination, but are more concerned with conforming closely to the plantar surface of an individual foot.

U.S. Pat. No. 6,141,889 describes a foot support having a plurality of non-parallel grooves and ridges based upon a scan of an individual foot, and U.S. Pat. No. 4,674,206 describes a midsole construction insert which utilizes an air cushion and an elastomeric resin for support of the foot. U.S. Pat. No. 6,029,374 describes a midsole system for a shoe having a sole spring, a heel spring and/or forefoot springs for a running shoe. Thus, these patents are primarily concerned with providing arch support, but do not control pronation/supination of the heel.

Finally, U.S. Pat. No. 3,058,240 describes a shoe which is designed from the sole up, to cling to the rear portion of the foot so that transverse constriction of the foot is unnecessary. The shoe of U.S. Pat. No. 3,058,240 is made of moisture pervious material so that it can hug the heel and arches with a glove-like clinging fit.

None of the previous art describes using a medial/lateral counter stabilizer to augment commercially manufactured shoes to provide increased arch support and heel alignment. Nor is there described a medial/lateral counter stabilizer comprising a full plantar aspect, a counter, lateral side wall support, and support of the metatarsal, medial and lateral arches, as a single unit.

Thus, there is a need for a foot stabilizer that provides both arch support and heel alignment in commercial shoes, and can be produced for integration as a part of a shoe to provide a shoe with superior control of calcaneal position and arch support. The stabilizer should be light-weight and of a simple design so that it may be adapted for most shoe types. The stabilizer should be designed to provide a preferred conformation for feet of different shapes and sizes. Additionally, the stabilizer should be designed to position the foot properly throughout the gait cycle. By providing arch support and controlling pronation and supination of the foot, a foot stabilizer controls subtalar joint motion and encourages plantar grade position during the gait. Shoes having medial/lateral counter foot stablizers are expected to help manage a variety of foot conditions including plantar fasciitis, pes planus, pes cavus, old fracture sites, hallux rigidus, lateral ankle sprains, metatarsalgia, bursitis, and plantar warts.

SUMMARY OF THE INVENTION

In one aspect, the invention comprises an orthotic stabilizer for a shoe comprising a plantar aspect which extends substantially the length of the sole of the shoe, a lateral side wall extending from at least a part of the plantar aspect, a medial wall extending from at least a part of the plantar aspect, and a heel cup counter.

In another aspect, the invention comprises a method of reducing foot and leg injury comprising integrating a lateral/medial counter foot stabilizer into a shoe, wherein the stabilizer comprises a plantar aspect which extends substantially the length of the sole of the shoe, a lateral side wall extending from at least a part of-the plantar aspect, a medial wall extending from at least a part of the plantar aspect, and a heel cup counter.

In another aspect, the invention comprises a method of reducing foot and leg injury comprising preventing heel misalignment and providing support for the lateral, medial and metatarsal arches.

In yet another aspect, the invention comprises a method for reducing foot and leg injury comprising integrating an orthotic stabilizer into a shoe, wherein the stabilizer is custom-molded to provide orthotic treatment to an individual foot, and wherein the stabilizer comprises a plantar aspect which extends substantially the length of the sole of the shoe, a lateral side wall extending from at least part of the plantar aspect, a medial wall extending from at least part of the plantar aspect, and a heel cup counter.

BRIEF DESCRIPTION OF THE DRAWINGS

Various features, aspects and advantages of the present invention will become more apparent with reference to the following description, appended claims, and accompanying drawings, wherein:

DETAILED DESCRIPTION OF THE INVENTION

Figure 1:
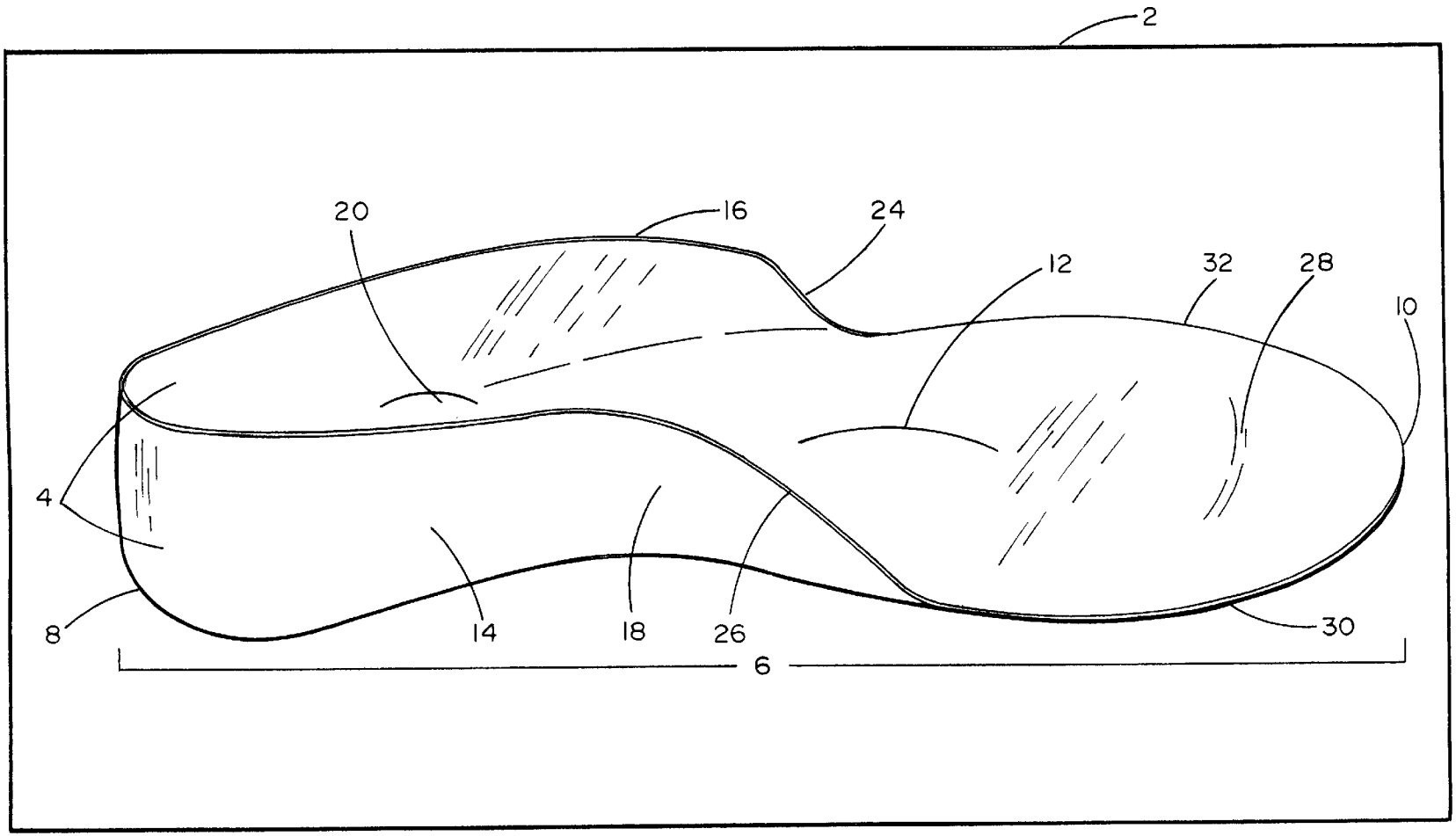
FIG. 1 is a representation of an aspect of an embodiment of the method and apparatus of the invention as viewed from the medial side.

Terms used herein are employed in their accepted sense or are defined. In this context, the present invention is directed to methods and an apparatus for providing a medial/lateral counter foot stabilizer that can be mass-produced as part of a shoe. Alternatively, the stabilizer of the invention may be integrated into pre-existing shoes.

In one aspect, the invention comprises an orthotic stabilizer for a shoe comprising a plantar aspect which extends substantially the length of the sole of the shoe, a lateral side wall extending from at least a part of the plantar aspect, a medial wall extending from at least a part of the plantar aspect, and a heel cup counter.

Preferably, the medial wall and plantar aspect comprise at least in part a medial arch support. More preferably, the apparatus of the invention comprises a series of stabilizers shaped to fit different sized medial arches.

Preferably, the lateral wall and said plantar aspect comprise at least in part a lateral arch support. More preferably, the apparatus of the invention comprises a series of stabilizers shaped to fit different shaped lateral arches.

Preferably, the plantar aspect comprises a metatarsal arch support. More preferably, the apparatus of the invention comprises a series of stabilizers shaped to fit different shaped metatarsal arches.

Preferably, the apparatus of the invention comprises a series of stabilizers having heel cup counters shaped to fit different sized heels. In an embodiment, the plantar aspect comprises a toe crest.

Preferably, the apparatus of the invention comprises a series of stabilizers shaped to fit different sized feet. In an embodiment, the plantar aspect, side walls, metatarsal arch support, lateral arch support and heel cup counter comprise a single piece. Preferably, the stabilizer of the invention is formed of a hard malleable light-weight material. Even more preferably, the stabilizer of the invention is formed of a polypropylene.

In an embodiment, the apparatus of the invention comprises a toe piece which is rounded upward. In an embodiment, the stabilizer comprises foam padding along at least a portion of the surface adjacent to the foot. Preferably, the invention includes shoes having the apparatus of the invention.

In another aspect, the invention comprises a method of reducing foot and leg injury comprising integrating a lateral/medial counter foot stabilizer into a shoe, wherein the stabilizer comprises a plantar aspect which extends substantially the length of the sole of the shoe, a lateral side wall extending from at least a part of the plantar aspect, a medial wall extending from at least a part of the plantar aspect, and a heel cup counter.

Preferably, the medial wall and plantar aspect comprise at least in part a medial arch support. More preferably, the method of the invention comprises a series of stabilizers shaped to fit different sized medial arches.

Preferably, the lateral wall and said plantar aspect comprise at least in part a lateral arch support. More preferably, the method of the invention comprises a series of stabilizers shaped to fit different shaped lateral arches.

Preferably, the plantar aspect comprises a metatarsal arch support. More preferably, the method of the invention comprises a series of stabilizers shaped to fit different shaped metatarsal arches.

Preferably, the method of the invention comprises a series of stabilizers having heel cup counters shaped to fit different sized heels. In an embodiment, the plantar aspect comprises a toe crest.

Preferably, the method of the invention comprises a series of stabilizers shaped to fit different sized feet. In an embodiment, the plantar aspect, side walls, metatarsal arch support, lateral arch support and heel cup counter comprise a single piece. Preferably, the stabilizer is formed of a hard malleable light-weight material. Even more preferably, the stabilizer is formed of a polypropylene.

Also more preferably, the stabilizer comprises a toe piece which is rounded upward. In an embodiment, a foot inserted into the stabilizer will have a heel rotation of less then 10 degrees during a standard gait.

In an embodiment, the stabilizer is produced as part of a commercial shoe. In an embodiment, the stabilizer is inserted into a pre-existing shoe.

In one aspect, the method of the invention comprises a method of reducing foot and leg injury comprising preventing heel misalignment and providing support for the lateral, metatarsal and medial arches. Preferably, the method further comprises a stabilizer having an extended plantar aspect and lateral and medial side walls to support the foot and prevent distortion or twisting of the counter. More preferably, the method comprises a stabilizer having lateral, medial, and metatarsal arches. Also more preferably, the method comprises a stabilizer having a toe crest. In an embodiment, a foot inserted into the stabilizer will have a heel rotation of less then 10 degrees during a standard gait.

In yet another aspect, the invention comprises a method for reducing foot and leg injury comprising integrating an orthotic stabilizer into a shoe, wherein the stabilizer is custom-molded to provide orthotic treatment to an individual foot, and wherein the stabilizer comprises a plantar aspect which extends substantially the length of the sole of the shoe, a lateral side wall extending from at least a part of the plantar aspect, a medial wall extending from at least a part of the plantar aspect, and a heel cup counter.

The medial wall and plantar aspect preferably comprise at least in part a medial arch support. Also, the lateral wall and the plantar aspect preferably comprise at least in part a lateral arch support. Also, the plantar aspect preferably comprises a metatarsal arch support. In an embodiment, the plantar aspect comprises a toe crest. In an embodiment, the method comprises making a mold of an individual foot and adjusting the mold shape to produce a stabilizer having a foot shape which will be therapeutic for the patient.

Thus, the invention comprises a method and an apparatus. The method includes creating a semi-rigid innersole medial/lateral counter foot stabilizer that is designed to replace or supplement the innersoles of commercially sold shoes and provide a degree of foot stabilization that is not possible in a shoe that does not include the stabilizer of the invention. The apparatus is the stabilizer itself. The stabilizers of the invention are generally sized to provide a shape which mimics the average contours for feet of a given shoe size. The stabilizer can be integrated to lie between the inner and outer lining of a shoe, and can be integrated during the manufacturing process or inserted into pre-existing shoes. Alternatively, the stabilizer may be individually molded to provide a specific orthotic treatment for an individual foot, and then integrated into a pre-existing shoe.

The apparatus and method of the invention provides a medial/lateral counter stabilizer which has a deep heel cup to limit rotation of the calcaneus (heel bone) and a plantar aspect which extends the length of the foot. In a preferred embodiment, the stabilizer comprises support for the medial, lateral, and metatarsal arches. The stabilizer of the invention corrects foot misalignment and provides increased arch support. The elongated plantar aspect connects the heel counter and the three arch supports as a single piece, thereby increasing the amount of stabilization and support provided.

By reducing misalignment of the heel and providing support for the major arches of the foot, the method and apparatus of the invention will alleviate many types of foot problems. The stabilizer of the invention provides arch support, controls pronation and supination of the foot, encourages plantar grade position during gait, allows the foot to achieve subtalar neutral position at all times, and controls subtalar joint motion. With the heel bone properly aligned, all other bones, such as the tibia, femur, and talus, are properly aligned as well. Thus, the stabilizer of the invention will alleviate many types of maladies related to foot misalignment such as lateral talocrural joint complications, plantar fasciitis, stress fractures, neuromas and heel spur complications.

The stabilizer of the invention is produced as a single unit for integration as part of a shoe, to provide a shoe with superior control of calcaneal position and arch support. The molded stabilizer can be mass-produced as part of the shoe by molding techniques such as thermoforming, injection molding, vacuum molding, and the like. Alternatively, the stabilizer can be mass-produced separately, and inserted into pre-existing shoes.

Figure 2:
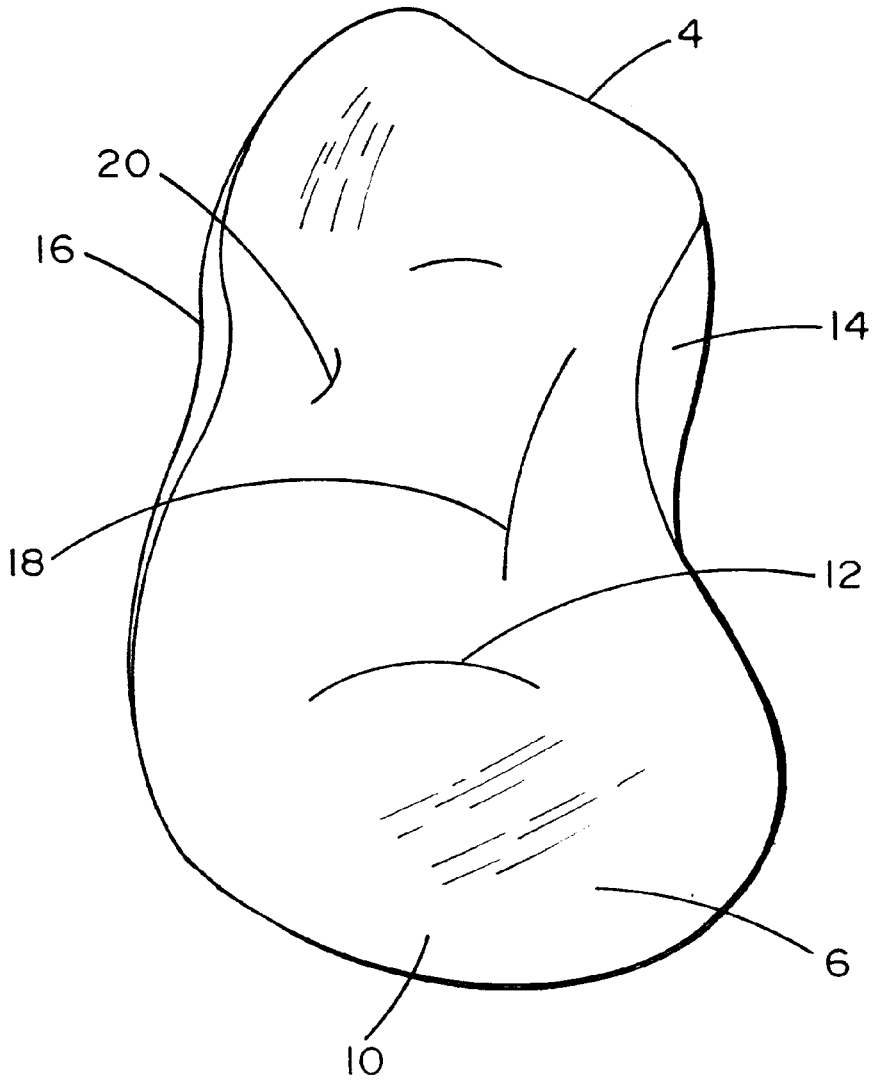
FIG. 2 is a representation of an aspect of an embodiment of the method and apparatus of the invention as viewed from the front.

In an embodiment, and referring now to FIGS. 1 and 2, stabilizer 2 roughly conforms to the contours of a foot, and includes a heel cup counter 4 and a plantar aspect 6 (lower surface) in connection with counter 4. Plantar aspect 6 merges with counter 4 and runs medially from the back of the heel 8 to the front of the big toe 10. The plantar aspect includes a tear-dropped convex mound 12 which is positioned proximal to the metatarsal head areas and adjacent the metatarsal arch of the foot. In this way, plantar aspect 6 conforms to, and provides support for, the metatarsal arch of the foot.

In an embodiment, plantar aspect also includes toe crest 28. Toe crest 28 comprises a rise which extends from medial side 30 of plantar aspect 6 to lateral side 32 of plantar aspect 6. Toe crest 28 is positioned so that it is distal to the metatarsal head region of the foot, and preferably in the sulcus area between the metatarsal head region and the proximal end of the toes. Thus, toe crest 28 is preferably shaped to rest adjacent to the metatarsal heads, thereby providing additional support for the toes during a typical gait.

Figure 3:
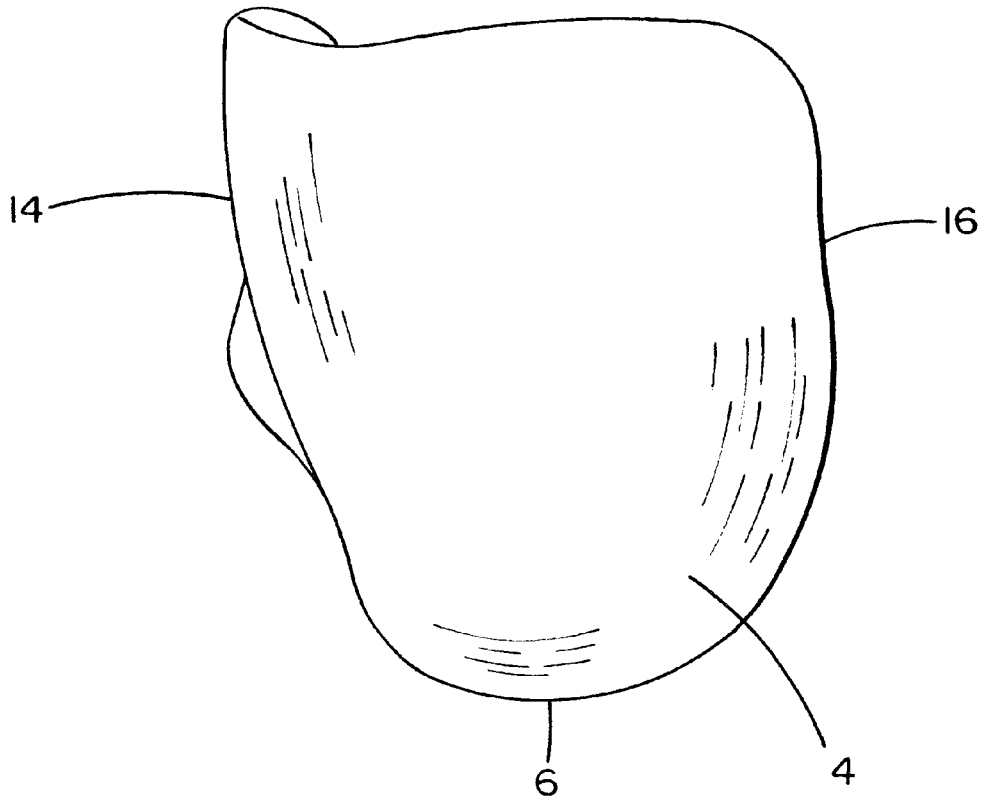
FIG. 3 is a representation of an aspect of an embodiment of the method and apparatus of the invention as viewed from the rear.
Figure 4:
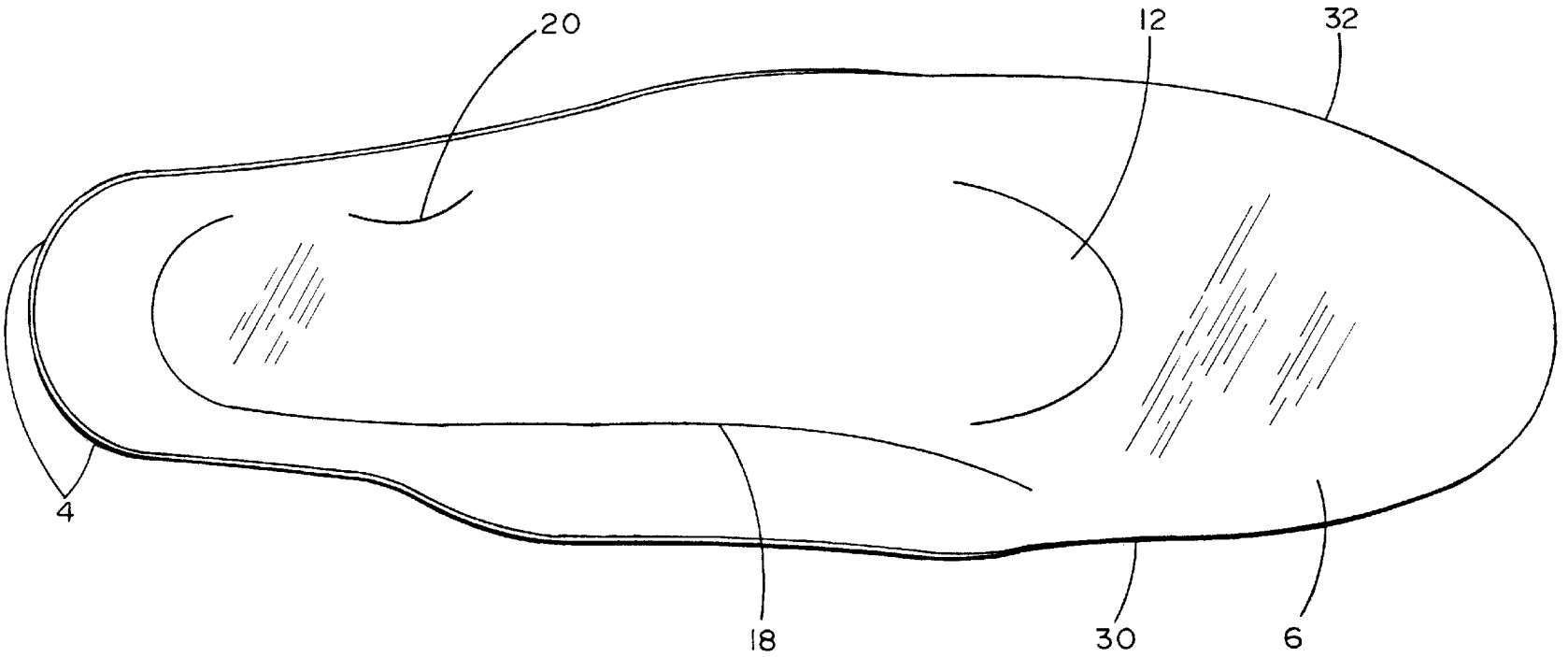
FIG. 4 is a representation of an aspect of an embodiment of the method and apparatus of the invention as viewed from the top.

Plantar aspect 6 further merges with side walls 14 and 16 of stabilizer 2. Similarly, side walls 14 and 16 merge with heel counter 4. Thus, stabilizer 2 comprises a single, one piece unit. Referring also to FIGS. 2, 3 and 4, it will be seen that the stabilizer is rounded where the sides 14 and 16 meet plantar aspect 6. By forming the stabilizer such that the heel and ball of the foot are not completely flat, the fat pad on the ball of the foot is kept in a thicker position throughout the gait cycle, thereby providing better arch support throughout the foot. This shape functions to slightly push up the sides of the foot and distribute the weight evenly to the rest of the foot and arches.

In an embodiment, and referring again to FIGS. 1 and 2, medial (inner) side wall 14 begins at about six millimeters proximal to the apex of the first metatarsal head. Medial side wall 14 and plantar aspect 6 comprise a rounded surface 18 which is positioned immediately adjacent to the medial arch of the foot. In the medial direction, the support extends from proximal to the first metatarsal head to a point distal to the calcaneus to form the medial arch support 18. In this way, stabilizer 2 conforms to, and provides support for, the medial arch of the foot.

In an embodiment, lateral (outer) side wall 16 and plantar aspect 6 comprise a rounded surface 20 which is positioned immediately adjacent to the lateral arch of the foot. Lateral arch support 20 extends from the distal end of the calcaneus to about the base of the fifth metatarsal. In this way, stabilizer 2 conforms to, and provides support for, the lateral arch of the foot.

In addition to providing support for the medial and lateral arches, side walls 14 and 16 provide support for the sides of the foot, and substantially reduce rotation of the heel in counter 4. Thus, side walls 14 and 16 of stabilizer 2 extend from plantar aspect 6 upward to support the foot. Side walls 14 and 16 should generally be of a shape and size in order to conform to the shoe that the stabilizer is integrated into. The invention contemplates side walls of varying height and length, but generally inclusive of the foot directly below the ankles. Side walls 14 and 16 are generally higher near heel counter 4, and descend at a point about midway between the head and the base of the metatarsals. As seen in FIG. 1, lateral trim line 24 preferably begins its decent from the highest position at a point midway between the fifth metatarsal head and the base of the fifth metatarsal. Lateral trim line 24 descends down to about the apex of the fifth metatarsal head, where plantar aspect 6 then continues the full length of the shoe. Medial trim line 26 preferably begins its decent distal to the navicular bone and descends down to about the apex of the first metatarsal head. The medial trim line 26 may or may not encompass the navicular depending upon the design of the shoe.

By having heel counter 4, attached to plantar aspect 6 and side walls 14 and 16, the stabilizer of the invention functions as a single unit to control the movement of the foot in the shoe. Counters found in traditional shoes are not attached to the innersole of the shoe, but can twist and expand relative to the rest of the shoe. This twisting of the counter thereby allows the heel to rotate, resulting in misalignment of the foot. In contrast, and referring again to FIGS. 1 and 2, any twisting movement of counter 4 in the stabilizer of the invention 2 is significantly impeded by side walls 14 and 16, and plantar aspect 6. Thus, in the stabilizer of the invention, twisting of the counter requires significant torque on the side walls and plantar aspect. The reduced ability of the counter to twist relative to the innersole of the shoe results in constraining the heel of the foot in the proper position, thereby significantly reducing misalignment of the foot.

In an embodiment, the medial/lateral counter foot stabilizer of the invention is integrated as part of a shoe. Preferably, the stabilizer is located between the inner and outer lining of the shoe and will replace the innersole of the shoe.

The stabilizer of the invention is made from a material which is firm enough to retain its shape when weight is placed on the foot, but which allows for flexing of the plantar aspect, arches and joints upon walking. The material should be lightweight so as not to significantly add to the weight of the shoe. In an embodiment, the stabilizer is made from polypropylene. Polypropylene is rigid enough to maintain arch support and other aspects of the subtalar neutral position when the wearer is standing, but allows for proper flexing of the foot during a normal gait. Although polypropylene is suitable for most applications, for some situations, such as support for a person with weakened or injured arches, a softer material such as polyethylene may be preferred. In an embodiment, padding, such as closed cell foam or the like, is used to cover at least part of the plantar aspect.

There are several variables to consider when designing an orthotic support suitable for mass production and use in commercial shoes. People vary in the amount of pronation and supination inherent to their gait, a difference which may become exacerbated over time. Also, people vary in weight, which may lead to inherent differences in the amount of stress placed on the feet. For example, heavier people tend to pronate their feet. Arch stiffness also varies among individuals. People with stiffer arches often have calluses on the balls of the foot and on the heel. Conversely, people with weakened arches may not have enough support in the foot, resulting in plantar fasciitis and other conditions.

In an embodiment, the medial/lateral counter stabilizer of the invention is designed to fit a prototype foot having preferred shapes for the medial, metatarsal, and lateral arches. In an embodiment, a series of stabilizers are designed to accommodate different shoe sizes, as well as different shaped feet. More preferably, for each foot size, the apparatus of the invention includes a series of stabilizers designed to fit differently shaped metatarsal arches, differently shaped lateral arches, or differently shaped medial arches. Also more preferably, the apparatus of the invention includes a series of stabilizers designed to fit differently shaped heel cups.

For example, people with relatively stiff arches tend to develop painful calluses on the heel and ball of the foot. This occurs because the arches do not touch the ground during a normal gait. The stabilizer of the invention designed with a high metatarsal arch functions to distribute more weight to the wearer's arch, reducing stress to the heel and ball of the foot. In contrast, people with overly flexible arches may not be getting enough support from the arches, and in some cases the arch may completely flatten during the gait cycle. The stabilizer of the invention designed with a standard metatarsal arch functions to maintain the foot in the desired shape during the gait cycle, thereby reducing trauma to the wearer's arches and allowing them to strengthen.

In an embodiment, the medial/lateral counter foot stabilizer of the invention is designed to provide a medial/lateral counter foot stabilizer which is the optimal shape for each foot/shoe size. Stabilizers of the invention may be made using thermoforming methods such as injection molding, blow molding, vacuum molding and the like.

In an embodiment, a series of stabilizers comprising different sizes (i.e. shoe sizes) and shapes (i.e. varying arch shapes) are made by vacuum molding. For example, a series of positive molds which are contoured as preferred shapes for feet of different sizes are produced using techniques standard in the art of orthotics. At least one separate mold is made for each foot size. Such molds can be made by making a model based on a foot of a given size and then altering the model to fit larger or smaller foot sizes. Alternatively, positive molds may be generated from negative castings taken from an actual foot. In an embodiment, plaster of Paris slippers are generated using a foot of a given size, and the slipper then used to prepare a positive mold of that foot size. Preferably positive castings are made using a durable material such as steel, aluminum and the like. To make the stabilizer, sheets of polypropylene are melted, e.g. in an oven, until the polypropylene becomes translucent. The softened polypropylene sheet is then laid on top of the positive casting, and a vacuum applied to induce the polypropylene to mold to the positive casting, thereby assuming the desired foot shape. The polypropylene mold is allowed to harden, and any excess plastic trimmed away. After polishing and smoothing the edges, the stabilizer is ready to be inserted in a shoe. Sizes may be based on commercial shoe sizes, or some other measuring standard.

In an embodiment, the stabilizer is mass-produced by injection molding. Injection molding uses a positive molding shaped as a foot and a negative cast which surrounds the mold. The positive mold and negative cast are designed such that there is an intervening space between the two. Melted plastic is injected into the intervening space, and upon hardening, forms a plastic mold which is shaped as a stabilizer.

Figure 5:
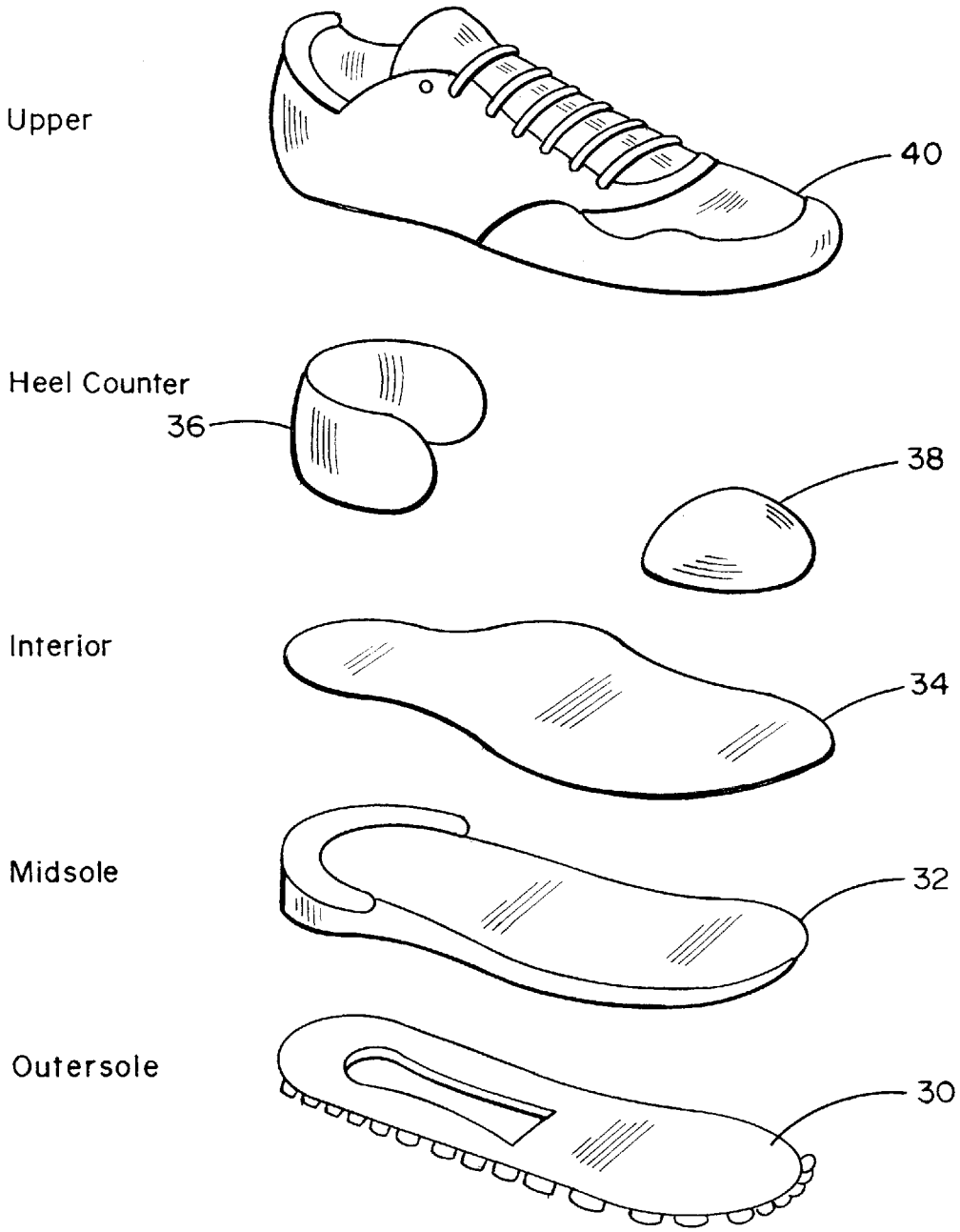
FIG. 5 is a representation of various components of a shoe without the stabilizer of the invention.
Figure 6:
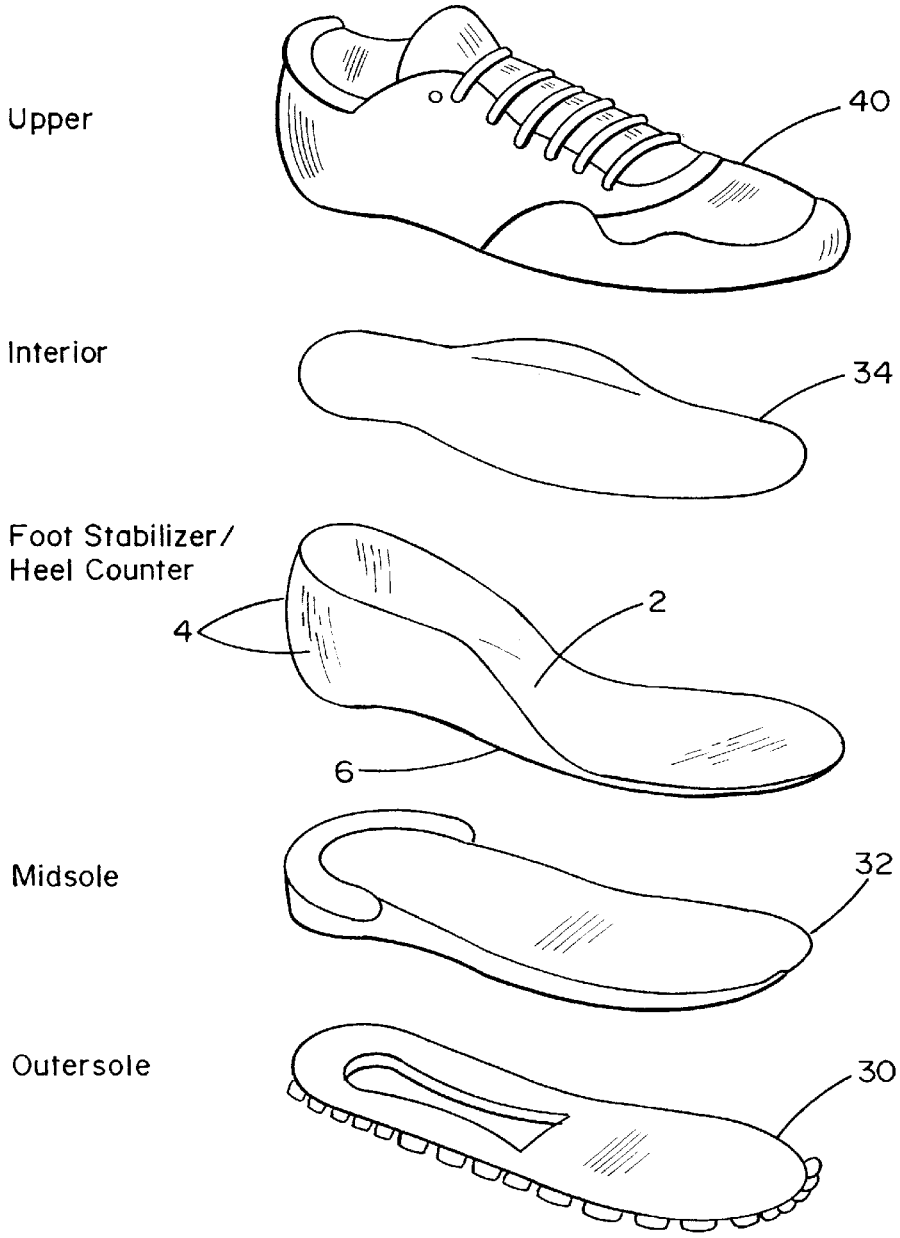
FIG. 6 is a representation of various components of a shoe with the stabilizer of the invention.

In one aspect, and referring now to FIGS. 5 and 6, the invention comprises a method of correcting foot and leg injury comprising integrating a lateral/medial counter foot stabilizer into a shoe, wherein the stabilizer comprises a plantar aspect which extends substantially the length of the sole of the shoe, a lateral side wall extending from at least part of the plantar aspect, a medial wall extending from at least part of the plantar aspect, and a heel cup counter. In a preferred embodiment the stabilizer includes a metatarsal arch support, a medial arch support, and a lateral arch support. Even more preferably, a series of stabilizers shaped to fit different sized feet, heel cups, and different shaped medial, lateral, and metatarsal arches are produced. Also preferably, the stabilizer comprises a toe crest.

Thus, the invention provides a method whereby a medial/lateral counter foot stabilizer is integrated during the manufacturing process of producing a normal shoe to provide increased foot alignment and arch support. The stabilizer of the invention is designed to lie between the inner and outer lining of the shoe to thereby replace the inner sole and heel counter of a commercial shoe. Referring now to FIG. 5, a typical manufactured shoe has an outer sole 30, a midsole 32 positioned on the upper surface of outer sole 30, an interior 34 positioned on top of midsole 32, an upper 40 positioned on top of, and connected to the perimeter of interior 34, a heel counter 36 positioned in the heel of upper 40 and on top of the rear perimeter of interior 34 and, in some cases, a toe piece 38. Thus, a manufactured shoe typically provides no component which functions to provide metatarsal, lateral, or medial arch support. Also, because interior 34 and counter 36 are two separate units, counter 36 is able to twist and flex relative to interior 34. This rotation of counter 36 relative to the rest of the shoe allows a heel positioned in the shoe to twist and flex relative to the plantar aspect of the foot, thereby resulting in pronation or supination and misalignment of the foot.

In contrast, and referring now to FIG. 6, a shoe comprising the stabilizer of the invention comprises outer sole 30, midsole 32, interior 34, and an upper 40. In this case, however, stabilizer 2 is positioned between midsole 32 and interior 34. Thus, in a shoe comprising the stabilizer of the invention, counter 4 is connected to a plantar aspect 6, thus providing a single unit which provides heel alignment and metatarsal, lateral, and medial arch support. This results in control of pronation and supination, a plantar grade position during gait, and a subtalar neutral position whether standing or in motion to thereby control subtalar joint motion.

Thus, the method of the invention comprises integrating a lateral/medial counter foot stabilizer into commercially made shoes as they are manufactured. The method contemplates having preset sizes based on the average contours for premeasured feet. Stabilizers can be mass produced using preformed sizes and shapes that fit the sizes and shapes of the manufactured shoes. When manufactured into the shoe, the medial/lateral counter foot stabilizer of the invention is attached between the inner and outer sole so as to form an integral unit. Thus, the method would replace the standard heel counter that comes with the commercial manufactured shoe.

The method of the invention can be applied to any shoe constructed with a solid upper section and an enclosed hind foot section. The method of the invention contemplates mass production of stabilizers chosen from pre-existing shoe sizes and foot shapes. It is also contemplated, however, that the lateral/medial counter foot stabilizer of the invention can be made to fit differing heel or arch sizes within a given shoe size, similar to the common practice of manufacturing shoes designed to fit wide, medium, and narrow feet.

In an embodiment, the method of the invention comprises inserting a medial/lateral counter stabilizer into a pre-existing shoe, rather than including the stabilizer as part of the manufacturing process. Thus, the method contemplates inserting a medial/lateral counter foot stabilizer into a shoe, such as the blucher or balmoral style of shoe, or any shoe that will support the stabilizer of the invention.

In yet another aspect, the invention comprises a method for reducing foot and leg injury comprising integrating an orthotic stabilizer into a shoe, wherein the stabilizer is custom-molded to provide orthotic treatment to an individual foot, and wherein the stabilizer comprises a plantar aspect which extends substantially the length of the sole of the shoe, a lateral side wall extending from at least part of the plantar aspect, a medial wall extending from at least part of the plantar aspect, and a heel cup counter. In a preferred embodiment the stabilizer includes a metatarsal arch support, a medial arch support, and a lateral arch support.

Thus, the method may include making a mold of an individual's foot to provide a medial/lateral counter foot stabilizer for that foot. For example, a slipper-like cast (negative) can be made using a person's foot, and used to make a mold shaped like the person's foot (positive). It is contemplated that the positive mold (or negative cast) may be an exact replica of the foot, or may be modified to effect the specific-orthotic treatment desired. For example, a positive cast may be posted to correct a forefoot valus or forefoot valgus condition. Generally, a subtalar neutral position, in which the individual in not putting weight on the foot, is used for generating the mold, although the specific position will depend on the treatment to be effected. In general, the subtalar neutral, non-weight bearing position minimizes several effects which occur upon standing, such as pronation of the heel, collapsing of the arches, and thinning of the fat pad on the calcaneus.

It will be understood that each of the elements described above, or two or more together, may also find utility in applications differing from the types described herein. While the invention has been illustrated and described as embodied as a method and apparatus for preventing and reducing foot injury by integrating a medial/lateral and counter foot stabilizer into a shoe, it is not intended to be limited to the details shown, since various modifications and substitutions can be made without departing in any way from the spirit of the present invention. For example, when the shoe extends proximal to the malleoli (as in the case of a boot), the stabilizer may extend to provide additional medial and lateral support or the trim lines may be extended dorsally. As such, further modifications and equivalents of the invention herein disclosed may occur to persons skilled in the art using no more than routine experimentation, and all such modifications and equivalents are believed to be within the spirit and scope of the invention as defined by the following claims.

What is claimed is:

1. An orthotic stabilizer for a shoe comprising:

a plantar aspect which extends substantially the length of the sole of a shoe;

a heel cup counter comprising a base and walls of sufficient height to support the medial and lateral sides of a heel positioned in said heel cup, and wherein said heel cup walls are each of substantially equal height and shaped to support the inner and outer heel to substantially the same extent;

a lateral side wall extending from said heel cup counter and at least a part of said plantar aspect, and wherein with respect to a foot positioned in the stabilizer, said lateral wall begins its descent from the counter at a point about midway between the fifth metatarsal head and the base of the fifth metatarsal to merge with the plantar aspect at a point just proximal to the apex of the fifth metatarsal head;

a medial wall extending from said heel cup counter and at least a part of said plantar aspect, wherein with respect to a foot positioned in the stabilizer, said medial wall begins its descent near the navicular bone and descends to merge with the plantar aspect at a point just proximal to the apex of the first metatarsal head;

and having said medial wall and said plantar aspect comprise a convex surface which at least in part comprises a medial arch support, said lateral wall and said plantar aspect comprise a convex surface which at least in part comprises a lateral arch support, and said plantar aspect comprise a convex mound which comprises a metatarsal arch support.

2. The stabilizer of claim 1, wherein said medial arch support comprises a shape selected from a variety of shapes which are designed to support different shaped medial arches.

3. The stabilizer of claim 1, wherein said lateral arch support comprises a shape selected from a variety of shapes which are designed to support different shaped lateral arches.

4. The stabilizer of claim 1, wherein said metatarsal arch support comprises a shape selected from a variety of shapes which are designed to support different shaped metatarsal arches.

5. The stabilizer of claim 1, wherein said heel cup counter comprises a shape selected from a variety of shapes which are designed to fit different sized heels.

6. The stabilizer of claim 1, wherein said plantar aspect comprises a toe crest.

7. The stabilizer of claim 1, wherein said plantar aspect, side walls, metatarsal arch support, lateral arch support, and heel cup counter comprise a single piece.

8. The stabilizer of claim 1, further comprising a hard malleable light-weight material.

9. The stabilizer of claim 8, wherein said hard malleable light-weight material is selected from the group consisting of polypropylene and polyethylene.

10. The stabilizer of claim 1, wherein said stabilizer comprises an overall size selected from a variety of sizes which are designed to fit different sized feet.

11. The stabilizer of claim 1, wherein the plantar aspect further comprises a toe piece which is rounded upward.

12. Shoes comprising the stabilizers of claim 1.

13. A method of correcting foot and leg injury comprising integrating a lateral/medial counter stabilizer in a shoe, wherein said lateral/medial counter stabilizer comprises:

a plantar aspect which extends substantially the length of the sole of a shoe;

a heel cup counter comprising a base and walls of sufficient height to support the medial and lateral sides of a heel positioned in said heel cup, and wherein said heel cup walls are of substantially the same height and shaped to support the inner and outer heel to substantially the same extent;

a lateral side wall extending from said heel cup counter and at least a part of the plantar aspect, and wherein with respect to a foot positioned in the stabilizer, said lateral wall begins its descent from the counter at a point about midway between the fifth metatarsal head and the base of the fifth metatarsal to merge with the plantar aspect at a point just proximal to the apex of the fifth metatarsal head;

a medial wall extending from said heel cup counter and at least a part of the plantar aspect, wherein with respect to a foot positioned in the stabilizer, said medial wall begins its descent near the navicular bone and descends to merge with the plantar aspect at a point just proximal to the apex of the first metatarsal head;

and having said medial wall and said plantar aspect comprise a convex surface which at least in part comprises a medial arch support, said lateral wall and said plantar aspect comprise a convex surface which at least in part comprises a lateral arch support, and said plantar aspect comprise a convex mound which comprises a metatarsal arch support.

14. The method of claim 13, further comprising a series of stabilizers shaped to fit different shaped medial arches.

15. The method of claim 13, further comprising a series of stabilizers shaped to fit different shaped lateral arches.

16. The method of claim 13, further comprising a series of stabilizers shaped to fit different shaped metatarsal arches.

17. The method of claim 13, further comprising a series of stabilizers having heel cup counters shaped to fit different sized heels.

18. The method of claim 13, wherein the plantar aspect comprises a toe crest.

19. The method of claim 13, wherein the plantar aspect, side walls, metatarsal arch support, lateral arch support, and heel cup counter comprise a single piece.

20. The method of claim 13, wherein the stabilizer comprises a hard malleable light-weight material.

21. The method of claim 13, further comprising a series of stabilizers shaped to fit different sized feet.

22. The method of claim 13, wherein the stabilizer is incorporated into a shoe as part of the manufacturing of the shoe.

23. The method of claim 13, wherein the stabilizer is inserted into a pre-existing shoe.

24. The method of claim 13, wherein upon being inserted into the stabilizer a foot is limited to having a heel rotation of less than 10 degrees during a standard gait.

25. A method for reducing foot and leg injury comprising prevention of heel misalignment due to pronation or supination of the foot and providing support for the lateral, metatarsal and medial arches, comprising: integrating a lateral/medial counter stabilizer into a shoe, wherein said stabilizer comprises an extended plantar aspect; lateral and medial side walls; a heel cup counter comprising a base and walls, wherein said walls of said counter are of substantially the same height and shaped to reduce rotation of a heel positioned in said heel cup counter to less than 10 degrees during a standard gait; and having said medial wall and said plantar aspect comprise a convex surface which at least in part comprises a medial arch support, said lateral wall and said plantar aspect comprise a convex surface which at least in part comprises a lateral arch support, and said plantar aspect comprise a convex mound which comprises a metatarsal arch support.

26. The method of claim 25, wherein the stabilizer further comprises a toe crest.

27. A method for reducing foot and leg injury comprising integrating an orthotic stabilizer into a shoe, wherein said stabilizer is custom-molded to provide orthotic treatment to an individual foot, and wherein said stabilizer comprises:

a plantar aspect which extends substantially the length of the sole of a shoe;

a heel cup counter comprising a base and walls of sufficient height to support the medial and lateral sides of a heel positioned in said heel cup, and wherein said heel cup walls are each of substantially the same height and shaped to support the inner and outer heel to substantially the same extent;

a lateral side wall extending from said heel cup counter and at least a part of the plantar aspect, and wherein with respect to a foot positioned in the stabilizer, said lateral wall begins its descent from the counter at a point about midway between the fifth metatarsal head and the base of the fifth metatarsal to merge with the plantar aspect at a point just proximal to the apex of the fifth metatarsal head;

a medial wall extending from said heel cup counter and at least a part of the plantar aspect, wherein with respect to a foot positioned in the stabilizer, said medial wall begins its descent near the navicular bone and descends to merge with the plantar aspect at a point just proximal to the apex of the first metatarsal head;

wherein said medial wall and said plantar aspect comprise a convex surface which at least in part comprises a medial arch support, said lateral wall and said plantar aspect comprise a convex surface which at least in part comprises a lateral arch support, and said plantar aspect comprise a convex mound which comprises a metatarsal arch support.

28. The method of claim 27, wherein the plantar aspect comprises a toe crest.

29. The method of claim 27, further comprising making a mold of an individual foot and adjusting the mold shape to produce a stabilizer having a foot shape which will be therapeutic for the patient.

* * * * *

UNITED STATES PATENT AND TRADEMARK OFFICE

CERTIFICATE OF CORRECTION

PATENT NO. : 6,594,922 B1
DATED : July 22, 2003
INVENTOR(S) : Paul A. Mansfield et al.

It is certified that error appears in the above-identified patent and that said Letters Patent is hereby corrected as shown below:

Title page,
Item [56], References Cited, U.S. PATENT DOCUMENTS, insert the following:

| | | | | |
|---|---|---|---|---|
| -- | 2,120,987 | June 21, 1938 | Murray | |
| | 2,177,304 | October 24 1939 | Murray | |
| | 2,668,304 | February 9, 1954 | Murray | |
| | 2,973,529 | March 7, 1961 | Silverman | |
| | 3,058,240 | October 16, 1962 | Osgood | |
| | 3,995,002 | November 30, 1976 | Brown | |
| | 4,137,654 | February 6, 1979 | Hlavac | |
| | 4,235,028 | November 25, 1980 | Riggs | |
| | 4,335,067 | June 15, 1982 | Castanis, et al. | |
| | 4,439,934 | April 3, 1984 | Brown | |
| | RE32,698 | June 21, 1988 | Brown | |
| | 4,597,196 | July 1, 1986 | Brown | |
| | 4,674,206 | June 23, 1987 | Lyden | |
| | 4,718,179 | January 12, 1988 | Brown | |
| | 4,731,087 | March 15, 1988 | Sculco, et al. | |
| | 4,882,856 | November 28, 1989 | Glancy | |
| | 5,394,626 | March 7, 1995 | Brown | |
| | 5,632,057 | May 27, 1997 | Lyden | |
| | 5,689,849 | November 25, 1997 | Charles | |
| | 6,029,374 | February 29, 2000 | Herr, et al. | |
| | 6,070,342 | June 6, 2000 | Brown | |
| | 6,141,889 | November 7, 2000 | Baum | -- |

Signed and Sealed this

Twenty-third Day of March, 2004

JON W. DUDAS
*Acting Director of the United States Patent and Trademark Office*